US006843213B2

(12) United States Patent
Saad et al.

(10) Patent No.: US 6,843,213 B2
(45) Date of Patent: Jan. 18, 2005

(54) AIR-FUEL CHARGE IN CRANKCASE

(75) Inventors: Philipe F. Saad, Columbus, IN (US); Lloyd Kamo, Columbus, IN (US); Roy Kamo, Columbus, IN (US)

(73) Assignee: Adiabatics, Inc., Columbus, IN (US)

( * ) Notice: Subject to any disclaimer, the term of this patent is extended or adjusted under 35 U.S.C. 154(b) by 0 days.

(21) Appl. No.: 10/282,103

(22) Filed: Oct. 29, 2002

(65) Prior Publication Data

US 2004/0079303 A1 Apr. 29, 2004

(51) Int. Cl.[7] ..... F02B 33/04
(52) U.S. Cl. ..... 123/73 A
(58) Field of Search ..... 123/73 A, 73 R, 123/73 C, 73 DA, 73 V, 73 S, 73 SC

(56) References Cited

U.S. PATENT DOCUMENTS 4,362,132 A 12/1982 Neuman
4,682,571 A * 7/1987 Kaufman et al. ..... 123/73 A
4,852,542 A 8/1989 Kamo
4,860,699 A 8/1989 Rocklein
5,063,890 A * 11/1991 Hironaka ..... 123/145 A
5,201,288 A * 4/1993 Doragrip ..... 123/73 DA
5,261,359 A 11/1993 Hull
5,820,976 A 10/1998 Kamo
5,967,103 A 10/1999 Kuperman
6,062,027 A * 5/2000 Landfahrer et al. ..... 60/605.2
6,216,649 B1 4/2001 Laydera-Collins
6,267,088 B1 7/2001 Rosskamp
6,612,293 B2 * 9/2003 Schweinzer et al. ... 123/568.12
6,622,681 B2 * 9/2003 Trumpf et al. ..... 123/184.21
2002/0026912 A1 3/2002 Kramer

* cited by examiner

*Primary Examiner*—Tony M. Argenbright
*Assistant Examiner*—Hyder Ali
(74) *Attorney, Agent, or Firm*—Paul B. Overhauser; Overhauser Law Offices, LLC

(57) ABSTRACT

A piston engine includes a nozzle-diffuser providing air-fuel to the crankcase. The nozzle-diffuser has input and output ends, and a throat between the input and output end having a cross sectional area that is smaller than the cross sectional areas of the input or output ends, and in which the interior surfaces of the intake port are tapered. The nozzle-diffuser may be housed in the crankshaft, and it alters the speed, pressure and temperature of the air fuel charge. Improvement of fuel air mixing to a more homogeneous charge and delivery rate of result in increased power, improved fuel economy and reduced exhaust gas emissions by the engine.

4 Claims, 4 Drawing Sheets

AIR-FUEL CHARGE IN CRANKCASE

FIELD OF THE INVENTION

The present invention relates to the field of internal combustion engines, more specifically, 2-stroke engines in which an air-fuel charge is delivered to the crankcase before passing into the combustion chamber.

BACKGROUND

Recent applications of engines have increased the importance of their durability, particularly where an engine must be run for a long time period. For example, internal combustion engines are now often used in drones or unmanned reconnaissance aircraft, which are required to continuously operate for well over 24 hours. This increases problems associated with the durability of the engine. It is also desirable to provide an engine that effectively operates on a variety of fuels, including gasoline, diesel fuel and heavy fuel. In addition, it is desirable to improve the combustion efficiencies of two stroke engines generally to obtain improved fuel economy and reduce emissions.

To accomplish these ends several approaches have been used in the past. Improved engine combustion is known to be improved by applying insulative ceramic layers to the combustion chamber surfaces, as disclosed for example, in U.S. Pat. No. 4,852,542 or 5,820,976. While this improves combustion by allowing the engine to run hotter, the increased heat also causes the engine components to breakdown more quickly. In addition, this approach increases the temperature of the air intake, which alters the appropriate air-fuel ratio and volumetric efficiency. While this might be addressed by adding a turbo charger or fuel injection system to the engine, such a system increases the size, weight and cost of the engine. Moreover, turbochargers generally increase engine wear because they require the engine to operate at even higher temperatures and pressures. Accordingly, providing additional insulating capacity to the combustion chamber surfaces is not suitable for engines that must be continuously operated for long time periods. Moreover, adding conventional turbo charging or fuel injection systems can increase the weight, size and cost of an engine to an unacceptable level.

It is also desirable to improve reduce toxic emissions from engines. While 2-stroke engines are generally more efficient than 4-stroke engines, they have very poor air handling or breathing characteristics unless they are fuel injected or turbocharged because of the natural intake and exhaust port timing characteristics of 2-stroke engines. When the air fuel (A/F) charge is directed into the combustion chamber, a small fraction of the exhaust port is still open. Because the air fuel charge of a 2-stroke engine is not mixed well it does not immediately burn. This combustion delay coupled with partially open exhaust port allows passage of some of the air fuel charge to escape from the open area exhaust port. In some cases, the amount of unburned fuel escaping to the exhaust train can be up to 60% of the original fuel charge. This pollutes the environment and wastes fuel. Accordingly, many manufacturers of, for example, outdoor power tools, are replacing the 2-stroke engines in their equipment with 4-stroke engines so as to provide a more environmentally friendly product.

Accordingly, it is desirable to provide an engine that can generate more power, uses less fuel, weighs less, costs less, and has improved emissions characteristics.

SUMMARY OF THE INVENTION

A piston engine includes a nozzle-diffuser providing air-fuel to the crankcase. The nozzle-diffuser has a input and output ends, and a throat between the input and output end having a cross sectional area that is smaller than the cross sectional areas of the input or output ends, and in which the interior surfaces of the intake port are tapered. The nozzle-diffuser may be housed in the crankshaft, and it alters the speed, pressure and temperature of the air fuel charge. Improvement of fuel air mixing to a more homogeneous charge and delivery rate result in improved fuel economy and reduced exhaust gas emissions by the engine.

DETAILED DESCRIPTION

The present invention can be used with engines such as 2-stroke engines that have intake porting to the cylinder(s) through the crankcase. The intake air-fuel charge is passed through a nozzle-diffuser into a crankcase. A "nozzle-diffuser" is an air-fuel port having an input end and an output end, a throat between the input and output end having a cross sectional area that is smaller than the cross sectional areas of the input or output ends, and in which the interior surfaces of the intake port are tapered.

Figure 3:
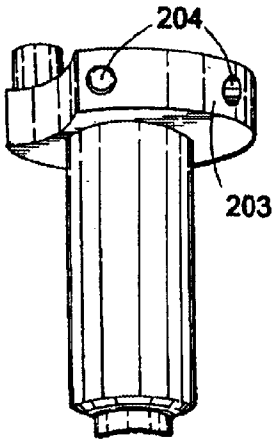
FIG. 3 is a side view of the crankshaft of FIG. 2 showing air-fuel exit ports in the counterbalance weight.
Figure 2:
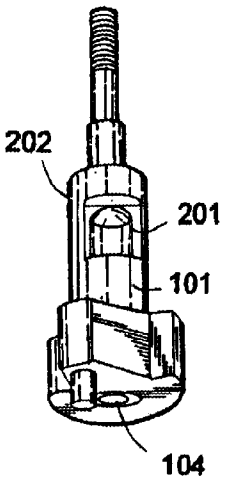
FIG. 2 is a perspective view of an engine crankshaft into which the nozzle-diffuser of FIG. 1 may be inserted.
Figure 1:
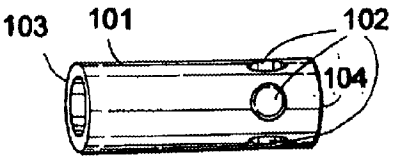
FIG. 1 is a side view of a nozzle-diffuser having three additional exit ports.

Referring to FIG. 1, nozzle-diffuser 101 may be cylindrical in exterior shape, having an input end 103, and an output end 104. Optionally, it may also include one or more radially extending exit ports 102. Nozzle-diffuser may be positioned at the point where the air-fuel of a two stroke engine enters the crankcase. In one embodiment, the air-fuel charge may enter via an axial cavity of the crankshaft. As shown in FIG. 2, crankshaft 202 may include an air-fuel entry area 201. Nozzle-diffuser 101 may be friction fitted or keyed into a bore within crankshaft 202 such that the input end 103 abuts the air-fuel entry area 201, and the output end 104 is generally flush with surface of counterweight 203. As shown in FIG. 3, counterbalance weight 203 may be provided with one or more air-fuel exit ports 204 which mate with exit ports 102 of nozzle diffuser. This configuration allows air-fuel to exit nozzle-diffuser through both output end 104 as well as exits ports 204.

Figure 4:
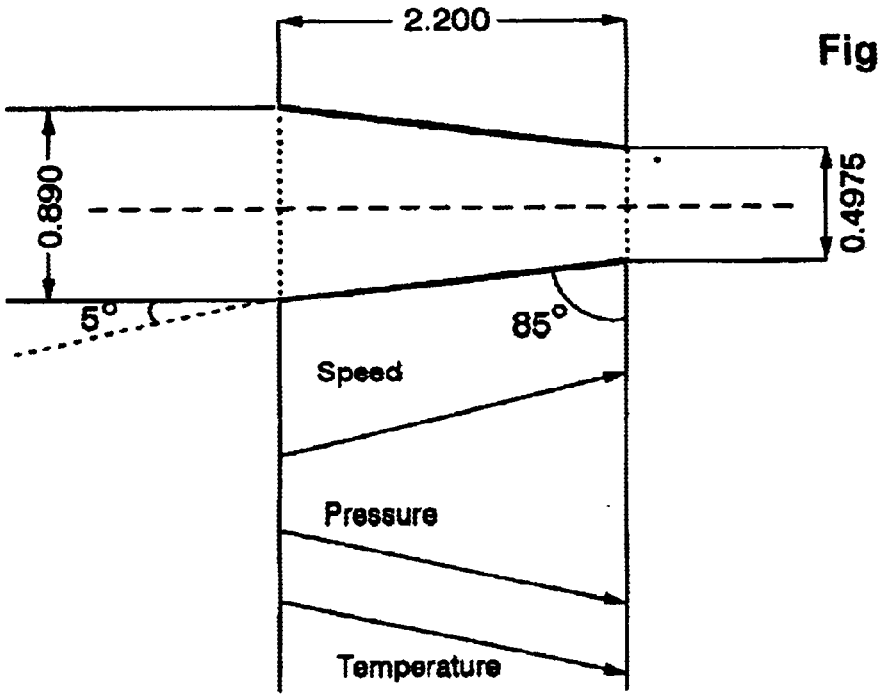
FIG. 4 is a graph showing representative interior dimensions of a nozzle, and its effect on the speed, pressure and temperature of an air-fuel charge passing through the nozzle.
Figure 6:
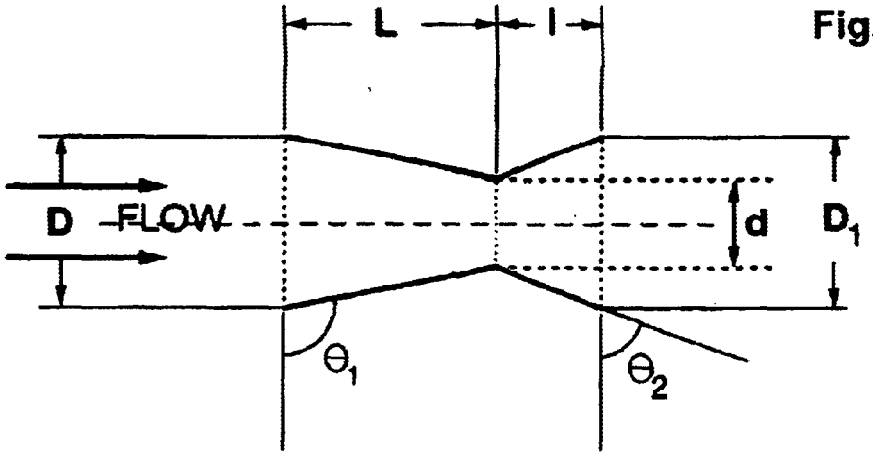
FIG. 6 is a is a diagram showing the relative dimensional parameters of a nozzle-diffuser.

As shown in FIG. 4 the dimensions of the nozzle of nozzle-diffuser may be as shown, with all dimensions being in centimeters. It will be appreciated that as the air passes through the nozzle, its speed will increase while its temperature and pressure will decrease for intake charge speeds of Mach number <1. As shown in FIG. 6, alternate dimensions for a nozzle-diffuser may be employed, and the effects on air speed, pressure and temperature will be as indicated for intake charge speeds of Mach number <1.

Figure 7:
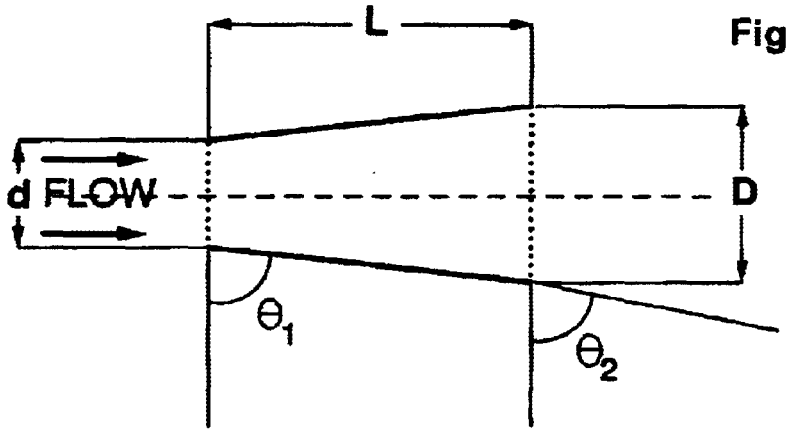
FIG. 7 is a is a diagram showing the relative dimensional parameters of a diffuser.
Figure 8:
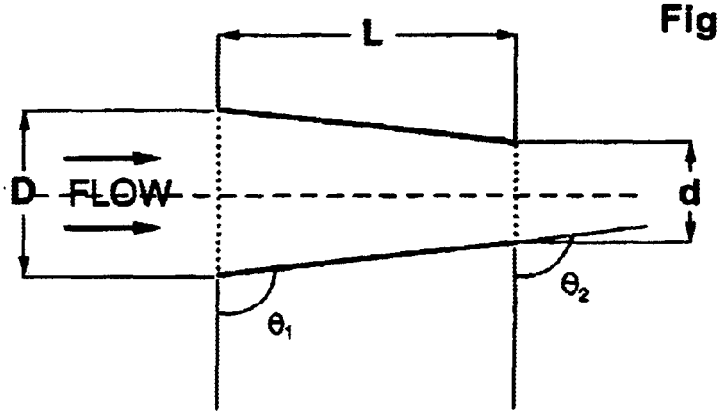
FIG. 8 is a is a diagram showing the relative dimensional parameters of a nozzle.
Figure 10:
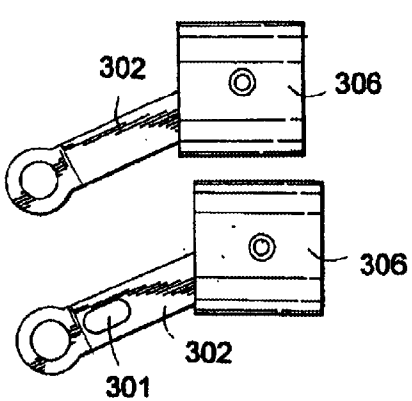
FIG. 10 is a side view of two pistons, one of which has an aperture in its connecting rod.

FIGS. 6, 7 and 8 show various dimensions and angles that may be used to design a nozzle diffuser for a particular engine. The principal function for the nozzle portion of the nozzle diffuser combination is creating more speed and reducing the pressure and the temperature of the air fuel intake charge.

The increase of the speed comes from the change of the cross sectional area. As air flows through the larger area to the smaller cross sectional area, the aerodynamic parameters of the air flow change and increased intake charge speed goes up.

The air speed can be calculated by the equation of continuity:

$$\frac{d\rho}{\rho} = \frac{dG}{G} - \frac{dF}{F} - \frac{dC}{C}$$

Where:

ρ—air density

G—air flow

F—section area

C—air flow speed

The air pressure can be calculated by the following equation:

$$dP = R(\rho dT + T d\rho) = \rho R\left(dT + T\frac{d\rho}{\rho}\right)$$

$$dP = \rho R\left[dT + T\left(\frac{dG}{G} - \frac{dF}{F} - \frac{dC}{C}\right)\right]$$

The Bernoulli equation relative $$\frac{dP}{\rho}:$$

$$\frac{dP}{\rho} = dl - CdC - dl_f$$

Where:

l—Work $l_f$—Friction work

The energy equation is:

$$dq+dl=C_\rho dT+CdC$$

$$C_p = \frac{k}{k-1}R$$

The air temperature can be calculated by the equation:

$$RdT = \frac{K-1}{K}dq + \frac{K-1}{K}dl - \frac{k-1}{k}CdC$$

Where:

R—Gas constant

K—Coefficient, K=1.4

Using these equations together we can calculate the speed:

$$\frac{dC}{C}(M^2-1) = \frac{dF}{F} - \frac{dG}{G} - \frac{k-1}{a^2}dq + \frac{1}{a^2}dl - \frac{k}{a^2}dl_r$$

Where:

$a^2$=K.RT q—Heat capacity

M—Mach number

Under the influence of geometry condition the speed can be calculated by the equation:

$$\frac{dC}{C}(M^2-1) = \frac{dF}{F}$$

The nozzle-diffuser provides two effects. It increases air turbulence of the air-fuel charge thus better mixing the air-fuel charge before it is communicated to the combustion chamber. Second, it increases the velocity and compression of the air-fuel, which mimics turbocharging or boosting of the air-fuel charge before admitting it to the combustion chamber. As a result of combustion, the mean effective pressure of the engine increases. The result is an increase of power, and this enables combustion of heavy fuels (compression ignition fuels) with minor ignition assist. Total efficiency of the engine increases, due to a dramatic improvement of air fuel mixture utilization. Moreover, these results are achieved without a conventional turbocharger or fuel; injection system, and without appreciable increase in weight or cost of the engine.

Figure 12:
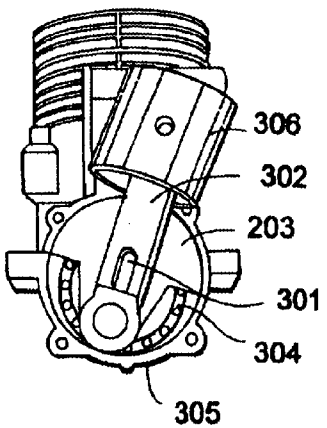
FIG. 12 is an end view of an engine with a connecting rod with an aperture, which shows how air-fuel exiting the nozzle diffuser can pass through the aperture of the connecting rod.
Figure 9:
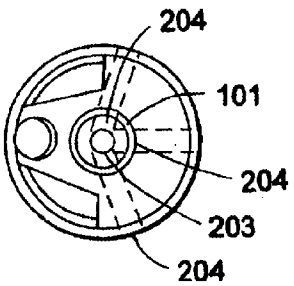
FIG. 9 is an end view of the crankshaft of FIG. 2.
Figure 11:
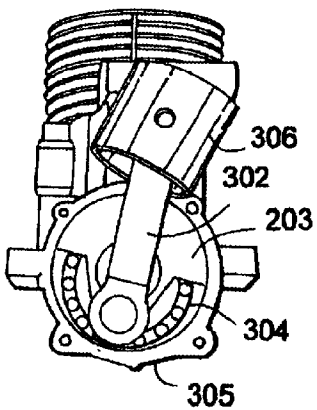
FIG. 11 is an end view of an engine with a connecting rod without an aperture.

In the embodiment shown in FIG. 9, the nozzle-diffuser is positioned to direct the air-fuel charge against moving engine components within the crankcase, such as a connecting rod. To enhance communication of the air-fuel charge to the crankcase (and combustion chamber) and improve air-fuel mixing, an aperture 301 may be placed in connecting rod 302. The improvement made by such a configuration is evidenced by comparing FIGS. 11 and 12. FIGS. 11 and 12 also show the relative position of the engine components connecting rod 302 and counterweight 203 within crankcase 304, which is enclosed by crankcase housing 305. As is conventional in many 2-stroke engines, the air fuel charge is in valved communication with the combustion chamber in which piston 306 reciprocates. In another embodiment, the counterweight 203 of crankshaft 202 has radial apertures 204 extending therethrough from the axis of the crankshaft to the outermost portion of the counterweight.

In one embodiment, a conventional two-stroke model airplane engine is modified, such as an Magnum 0.40XL non-ringed engine available from Magnum Service of Fountain Valley, Calif. Tests performed using this engine reveal significant performance improvement from using the nozzle-diffuser of the present invention. For example, prior to modification to incorporate the present invention, the engine was run, generating 0.349 HP with a 0.540 lbs./hr. fuel consumption rate. Having been modified to implement features of the present invention, the modified engine realizes 0.461 HP while maintaining the same 0.540 lbs./hr. fuel rate. This is a 32% improvement in HP while maintaining the same fuel rate.

Figure 5:
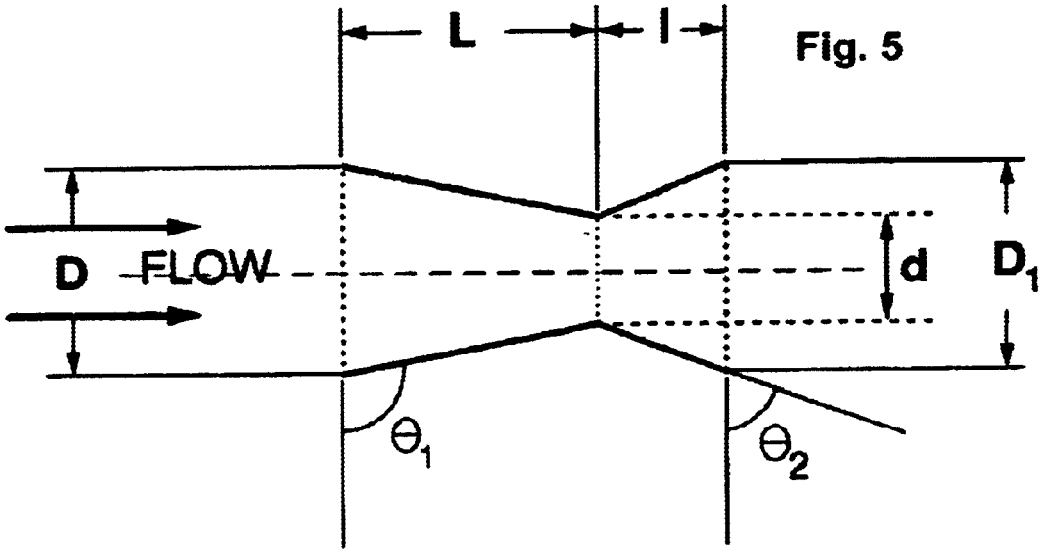
FIG. 5 is a is a graph showing representative interior dimensions of a nozzle-diffuser, and its effect on the speed, pressure and temperature of an air-fuel charge passing through the nozzle diffuser.

Tests reveal that if the nozzle (see FIG. 4) alone (without the diffuser) is used in the crankshaft by itself, it will generate an improvement in horsepower of about 17.1%. (Baseline engine=0.349 HP vs. 0.410 HP). Fuel consumption is about 15% better. For the entire nozzle-diffuser in the crankshaft (see FIG. 5), this HP increased to 0.426 HP or about 21.7% increase in HP. Fuel consumption was variable but depended upon the throat diameter exiting the nozzle. The improvement was about 15 to 20% better in fuel economy.

When the same engine was further modified to include the aperture in the connecting rod, improved fuel consumption resulted. The combination jumped from the 20% increase to 28–30% increase in fuel economy.

Inclusion of the holes in the counterbalance weight into the diffuser made performance more steady. That is before, there existed fluctuation if there was a breeze blowing into the engine, but with the holes, running was smoother and more consistent. Optimization of holes in the counterbalance weight will also improve engine performance by 3% to 5% should the aperture 301 in the connecting rod not be desired due to a reduction in strength of the connecting rod.

The nozzle/diffuser parameters appear to determine the level of engine horsepower increase. The throat diameter between the two allows adjustment of the fuel rate. The smaller the throat diameter, the lower the fuel rate or better the fuel economy. There is a point where too small of a throat diameter will cause a drop off in power or reduced HP.

Another set of test results using an OS Max 0.50 in.$^3$ SX engine available from OS Engine Mfg. Co. Ltd. of Osaka, Japan, is summarized as follows:

| Engine and Displacement | Nozzle-Diffuser Size (length × pitch) | Fuel Type | %2-cycle oil | Fuel Rate | HP | BSFC | Engine Speed |
|---|---|---|---|---|---|---|---|
| BASELINE OS Max 0.5 in$^3$ | 12 × 8 | JP-5 | 16 | 0.798 | 0.570 | 1.42 | 7000 |
| OS Max 0.5 in$^3$ | 12 × 8 | JP-5 | 16 | 0.908 | 0.723 | 1.25 | 9100 |
| OS Max 0.5 in$^3$ | 12 × 8 | JP-5 | 16 | 0.860 | 0.626 | 1.37 | 8800 |
| OS Max 0.5 in$^3$ | 12 × 8 | No. 2 Diesel | 16 | 0.910 | 0.690 | 1.31 | 9000 |
| OS Max 0.5 in$^3$ | 12 × 8 | JP5/JP8 | *** | 0.720 | 0.600 | 1.20 | 8500 |

Fuel rate is in lbs./hr., ** BSFC is brakes specific fuel consumption or fuel rate÷HP (units lbs./HP-hr), An engine may also run on nitromethane, alcohol and gasoline, so a 2 cycle engine multi-fuel engine is possible. Each type of fuel will require optimization for best performance.

It will be understood that various details of the invention may be changed without departing from the spirit and scope of the invention. Furthermore, the foregoing description is for illustration only, and not for the purpose of limitation, the invention being defined by the claims. For example, the cross section area of the nozzle diffuser may be non-circular, or the nozzle-diffuser may be positioned to introduce the air-fuel charge to other portions of the crankcase.

The references listed below as well as all references cited in this specification are incorporated herein by reference to the extent that they supplement, explain, provide a background for or teach methodology or techniques employed herein: U.S. Pat. Nos. 4,362,122, 4,860,699, 5,261,359, 5,967,103, 6,216,649, 6,267,088 and published patent application no. 2002/26,912A.

We claim:

1. A piston engine comprising:

a crankcase;

a combustion chamber;

a nozzle-diffuser providing air-fuel to the crankcase, the nozzle-diffuser comprising:

an input end and an output end, a throat between the input and output end having a cross sectional area that is smaller than the cross sectional areas of the input or output ends, and in which the interior surfaces of the intake port are tapered;

the crankcase being in valved communication with the combustion chamber; and a crankshaft containing the nozzle-diffuser.

2. The piston engine of claim 1 further comprising:

a piston counterbalance weight connected to the crankshaft;

at least one air-fuel exit channel extending from the output end of the nozzle-diffuser and passing through the counterbalance weight.

3. The piston engine of claim 2 further comprising:

a piston connecting rod having an aperture through which air-fuel exiting the outlet end of the nozzle-diffuser passes.

4. The piston engine of claim 1 further comprising:

a piston connecting rod having an aperture through which air-fuel exiting the outlet end of the nozzle-diffuser passes.

* * * * *